US008991045B2

(12) United States Patent
Poma et al.

(10) Patent No.: US 8,991,045 B2
(45) Date of Patent: Mar. 31, 2015

(54) GROUNDING ARRANGEMENT AND METHOD FOR A SHIELDED CABLE

(71) Applicant: Delphi Technologies, Inc., Troy, MI (US)

(72) Inventors: Eric B. Poma, Hubbard, OH (US); Bruce D. Taylor, Cortland, OH (US); Ronald A. Baldwin, Cortland, OH (US); Kenneth B. Germ, Niles, OH (US)

(73) Assignee: Delphi Technologies, Inc., Troy, MI (US)

( * ) Notice: Subject to any disclaimer, the term of this patent is extended or adjusted under 35 U.S.C. 154(b) by 203 days.

(21) Appl. No.: 13/795,046

(22) Filed: Mar. 12, 2013

(65) Prior Publication Data

US 2014/0259660 A1 Sep. 18, 2014

(51) Int. Cl.
*H01R 43/04* (2006.01)
*H01R 9/05* (2006.01)

(52) U.S. Cl.
CPC ..... *H01R 9/0518* (2013.01)
USPC ..... 29/862; 29/828; 29/857; 29/861

(58) Field of Classification Search
CPC ..... H01R 9/05; H01R 9/0518; H01R 23/662; H01R 12/775; H01R 13/6592
USPC ..... 29/862, 762, 764, 795, 828, 857, 861, 29/867; 174/75 C, 84 C, 88 C
See application file for complete search history.

(56) References Cited

U.S. PATENT DOCUMENTS

| | | | | |
|---|---|---|---|---|
| 3,538,239 | A | 11/1970 | Floyd, Jr. | |
| 4,415,223 | A | 11/1983 | Asick | |
| 5,028,742 | A | 7/1991 | Redman | |
| 5,432,301 | A | 7/1995 | Gehring | |
| 6,536,103 | B1 * | 3/2003 | Holland et al. | 29/828 |
| 6,776,196 | B2 * | 8/2004 | Yamakawa | 140/71 R |
| 7,598,455 | B2 | 10/2009 | Gump et al. | |
| 2002/0153157 | A1 | 10/2002 | Harger et al. | |
| 2003/0153157 | A1 | 8/2003 | Foad et al. | |

FOREIGN PATENT DOCUMENTS

| | | | |
|---|---|---|---|
| JP | 10-012298 | A | 1/1998 |
| JP | 2004-087352 | A | 3/2004 |

OTHER PUBLICATIONS

International Search Report PCT/US2014/022941, Aug. 26, 2014.

* cited by examiner

*Primary Examiner* — Thiem Phan
(74) *Attorney, Agent, or Firm* — Patrick M. Griffin

(57) ABSTRACT

A method is provided for forming a grounding arrangement on a shielded cable which includes a conductive core, a core insulation layer, a conductive shield layer, and an outer insulation layer. An inner ferrule is positioned adjacent an end portion of the conductive shield layer that has been exposed, the inner ferrule is crimped around the core insulation layer, and the end portion is folded over the inner ferrule to radially surround the inner ferrule. An electrically conductive outer ferrule is positioned radially adjacent to the end portion and the outer ferrule is crimped radially around the inner ferrule to capture the end portion radially between the inner ferrule and the outer ferrule, thereby fixing the outer ferrule in electrical contact with the conductive shield layer.

18 Claims, 4 Drawing Sheets

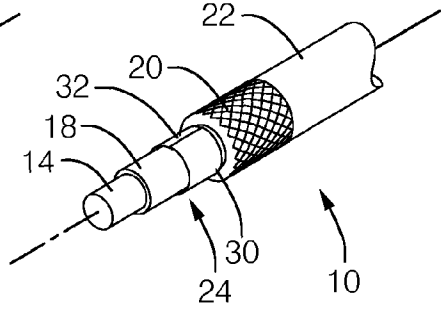
FIG. 10
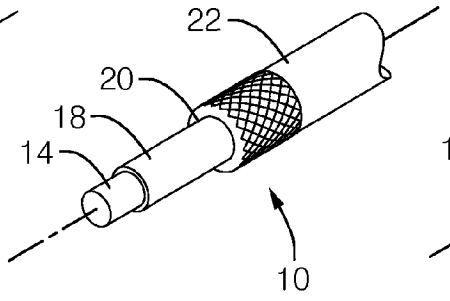
FIG. 11
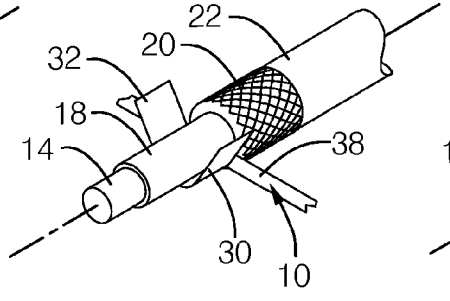
FIG. 12
FIG. 13
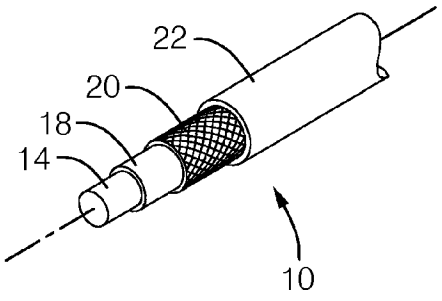
FIG. 14
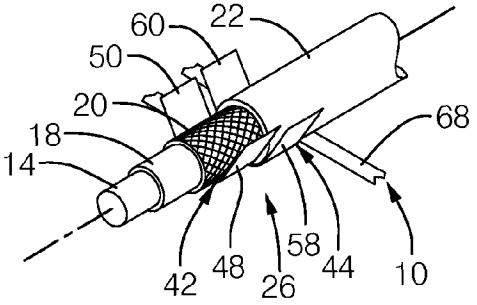
FIG. 15
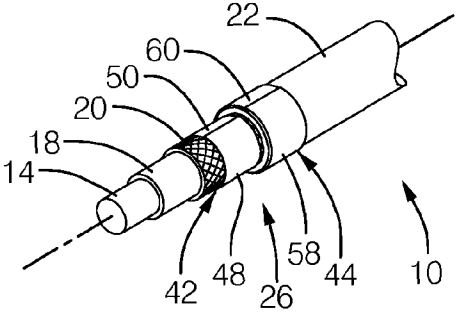
FIG. 16

GROUNDING ARRANGEMENT AND METHOD FOR A SHIELDED CABLE

TECHNICAL FIELD OF INVENTION

The present invention relates to a shielded cable; more particularly to a grounding arrangement for the shielded cable, and still even more particularly to a method for forming the grounding arrangement on the shielded cable.

BACKGROUND OF INVENTION

Cables are known for transmitting electrical current and/or signals from a first to device to a second device. In an example shown in U.S. Pat. No. 7,598,455 on Oct. 6, 2009 to Gump et al., a shielded cable includes a conductive core surrounded by a core insulation layer to electrically insulate the conductive core. The core insulation layer is surrounded by a conductive shield layer in the form of a metallic braid that is woven around the core insulation layer in order to shield any electronic devices in the vicinity of the cable from electromagnetic interference (EMI) caused by electric current flowing through the conductive core. An outer insulation layer surrounds the conductive shield layer. The end of the cable is cut circumferentially at three axial spaced locations with the cuts being successively deeper in order to expose lengths of the conductive core, core insulation layer, and conductive shield layer. In order to ground the conductive shield layer, an annular inner ferrule is disposed between the core insulation layer and the exposed portion of the conductive shield layer and an annular outer ferrule is disposed around the exposed portion of the conductive shield layer and crimped thereto, thereby capturing the conductive shield layer between the inner ferrule and the outer ferrule. The inner ferrule and outer ferrule are loose-piece and are manufactured using deep drawing or machining processes, thereby requiring the inner ferrule and outer ferrule to be manually assembled to the cable.

U.S. Pat. No. 3,538,239 to Henshaw on Nov. 3, 1970 teaches an inner and outer ferrule for a shielded cable where the inner ferrule and outer ferrule are connected together by a strap and integrally formed together from sheet metal where the inner ferrule is formed into an annular shape and the outer ferrule is formed into a U-shape prior to the inner ferrule and outer ferrule being applied to the shielded cable. While this inner and outer ferrule arrangement may allow manufacture of the inner ferrule and the outer ferrule to be to be automated, it may be difficult to position the inner ferrule between the core insulation layer and the conductive shield layer. Furthermore, the inner ferrule being formed into an annular shape prior to being assembled to the shielded cable limits its use to a single gauge size of wire.

What is needed is a grounding arrangement for a shielded cable which minimizes or eliminates one or more of the shortcomings as set forth above.

SUMMARY OF THE INVENTION

Briefly described, a method is provided for forming a grounding arrangement on a shielded cable which includes a conductive core, a core insulation layer radially surrounding the conductive core, a conductive shield layer radially surrounding the core insulation layer, and an outer insulation layer radially surrounding the conductive shield layer. The method includes removing a length of the outer insulation layer to expose an end portion of the conductive shield layer. An inner ferrule is provided which is configured to be crimped around the shielded cable. The inner ferrule is positioned adjacent to the end portion of the conductive shield layer that has been exposed, the inner ferrule is crimped around the core insulation layer, and the end portion of the conductive shield layer is folded over the inner ferrule to radially surround the inner ferrule. An electrically conductive outer ferrule is provided which is configured to be crimped around the inner ferrule. The outer ferrule is positioned radially adjacent to the end portion of the conductive shield layer that has been positioned to radially surround the inner ferrule and the outer ferrule is crimped radially around the inner ferrule to capture the end portion of the conductive shield layer radially between the inner ferrule and the outer ferrule, thereby fixing the outer ferrule in electrical contact with the conductive shield layer.

BRIEF DESCRIPTION OF DRAWINGS

This invention will be further described with reference to the accompanying drawings in which:

FIG. 10 is an isometric view of the shielded cable of FIG. 1 prepared to receive the grounding arrangement of the present invention in a method of a second embodiment;

FIG. 11 is an isometric view of the shielded cable of FIG. 10 with a conductive shielded layer of the shielded cable folded backward over an outer insulation layer;

FIG. 12 is an isometric view of the shielded cable of FIG. 11 with the inner ferrule of FIG. 2 positioned adjacent to the conductive shield layer of the shielded cable;

FIG. 13 is an isometric view of the shielded cable of FIG. 12 with the inner ferrule crimped around a core insulation layer of the shielded cable;

FIG. 14 is an isometric view of the shielded cable of FIG. 13 with the conductive shield layer positioned over the inner ferrule;

FIG. 15 is an isometric view of the shielded cable of FIG. 14 with the outer ferrule of FIG. 3 positioned adjacent to the conductive shield layer;

FIG. 16 is an isometric view of the shielded cable of FIG. 15 with the outer ferrule crimped around the conductive shield layer;

DETAILED DESCRIPTION OF INVENTION

Figure 1:
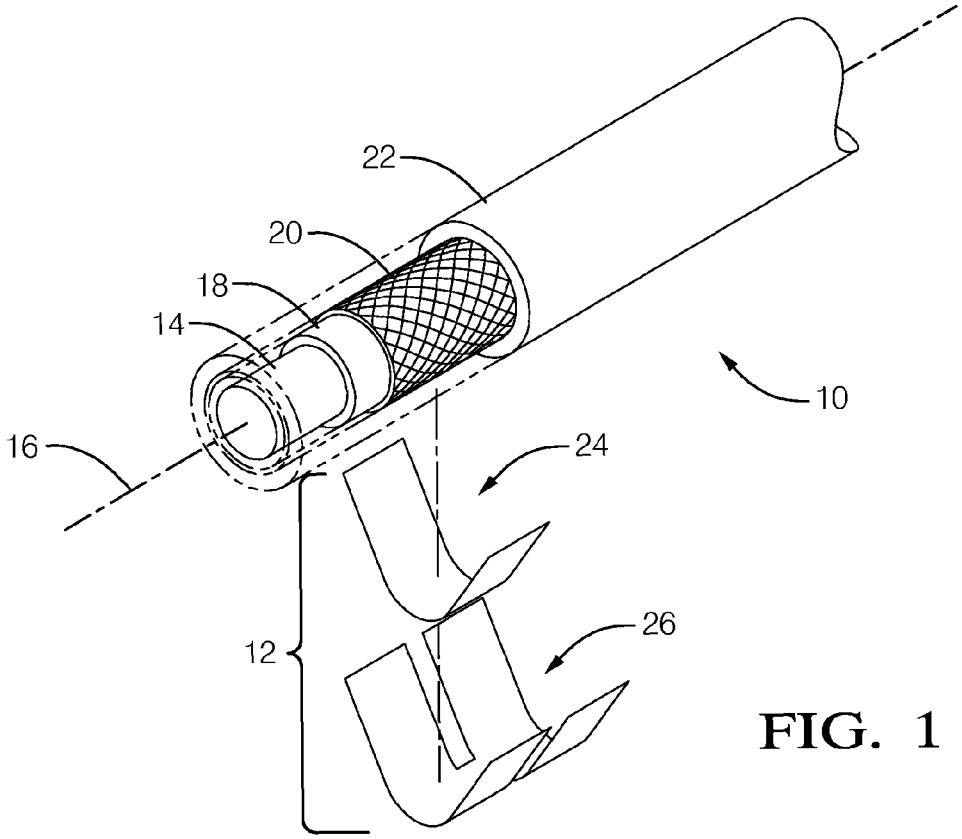
FIG. 1 is an isometric exploded view of a shielded cable with a grounding arrangement in accordance the present invention.

Referring to FIG. 1, an exploded isometric view of a shielded cable 10 is shown which has been prepared to receive a grounding arrangement 12. Shielded cable 10 includes a conductive core 14 extending along a shielded cable axis 16, a core insulation layer 18 coaxially and radially surrounding conductive core 14, a conductive shield layer 20 coaxially and radially surrounding core insulation layer 18, and an outer insulation layer 22 coaxially and radially surrounding conductive shield layer 20. Conductive core 14 is a metallic material, for example only, copper, aluminum, alloys thereof, or any other metallic material suitable for conducting electricity. Core insulation layer 18 and outer insulation layer 22 are made of an electrically insulative material. Conductive shield layer 20 is a metallic material, for example only, braided metal wire woven around core insulation layer 18 that is suitable for conducting electricity. Conductive shield layer 20 may shield electronic devices in the vicinity of shielded cable 10 from EMI caused by electric current flowing through conductive core 14.

Figure 4:
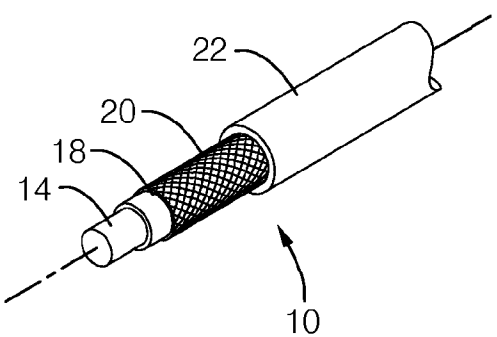
FIG. 4 is an isometric view of the shielded cable of FIG. 1 prepared to receive the grounding arrangement of the present invention in a method of a first embodiment.

With continued reference to FIG. 1 and with additional reference to FIGS. 4 and 10, shielded cable 10 has been prepared to receive grounding arrangement 12 by cutting the end portion of shielded cable 10 in three axially spaced locations with each cut being successively deeper so that a portion of outer insulation layer 22 may be removed to expose an end portion of conductive shield layer 20, a portion of conductive shield layer 20 may be removed to expose core insulation layer 18, and a portion of core insulation layer 18 may be removed to expose conductive core 14. The portions of outer insulation layer 22, conductive shield layer 20, and core insulation layer 18 that are removed are illustrated as phantom lines in FIG. 1.

Figure 2:
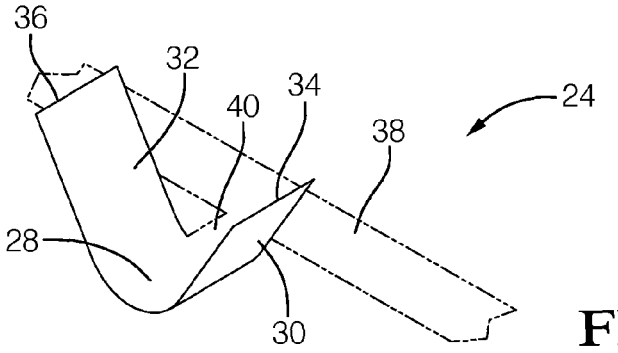
FIG. 2 is an isometric view of an inner ferrule of the grounding arrangement in accordance with the present invention prior to being assembled to the shielded cable.
Figure 3:
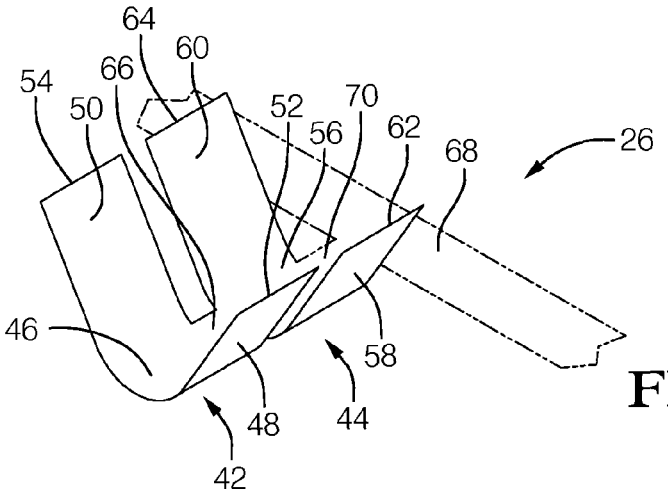
FIG. 3 is an isometric view of an outer ferrule of the grounding arrangement in accordance with the present invention prior to be assembled to the shielded cable.

With continued reference to FIG. 1 and with additional reference to FIGS. 2 and 3, grounding arrangement 12 includes an inner ferrule 24 configured to be crimped around core insulation layer 18 and an outer ferrule 26 configured to be crimped around inner ferrule 24. Inner ferrule 24 includes an inner ferrule base portion 28, a first inner ferrule crimp wing 30 and a second inner ferrule crimp wing 32. First inner ferrule crimp wing 30 and second inner ferrule crimp wing 32 extend from opposing sides of inner ferrule base portion 28 such that inner ferrule 24 may be substantially V-shaped or U-shaped as shown in FIGS. 1 and 2 prior to assembly of inner ferrule 24 to shielded cable 10. Inner ferrule base portion 28 may be arcuate in shape as shown. First inner ferrule crimp wing 30 is attached at one end to inner ferrule base portion 28 while the other end is free and defines a first inner ferrule crimp wing free end 34. Similarly, second inner ferrule crimp wing 32 is attached at one end to inner ferrule base portion 28 while the other end is free and defines a second inner ferrule crimp wing free end 36. Inner ferrule 24 may be formed from a sheet of electrically conductive sheet stock by conventional metal forming techniques such as punching and stamping. As shown in FIG. 2, inner ferrule 24 may be formed with an inner ferrule carrier strip 38 and connected thereto with an inner ferrule carrier connecting strap 40. While not shown, inner ferrule carrier strip 38 may include a plurality of inner ferrules 24 in order to facilitate automated production of inner ferrules 24 and also to facilitate automated assembly of inner ferrule 24 to shielded cable 10. Assembly of inner ferrule 24 to shielded cable 10 will be discussed in detail later.

Outer ferrule 26 includes an outer ferrule to cable attachment section 42 and may include an outer ferrule grounding section 44. Outer ferrule to cable attachment section 42 includes an outer ferrule to cable attachment section base portion 46, a first outer ferrule crimp wing 48 and a second outer ferrule crimp wing 50. First outer ferrule crimp wing 48 and second outer ferrule crimp wing 50 extend from opposing sides of outer ferrule to cable attachment section base portion 46 such that outer ferrule to cable attachment section 42 may be substantially V-shaped or U-shaped as shown in FIGS. 1 and 3 prior to assembly of outer ferrule 26 to shielded cable 10. Outer ferrule to cable attachment section base portion 46 may be arcuate in shape as shown. First outer ferrule crimp wing 48 is attached at one end to outer ferrule to cable attachment section base portion 46 while the other end is free and defines a first outer ferrule crimp wing free end 52. Similarly, second outer ferrule crimp wing 50 is attached at one end to outer ferrule to cable attachment section base portion 46 while the other end is free and defines a second outer ferrule crimp wing free end 54.

Outer ferrule grounding section 44 includes an outer ferrule grounding section base portion 56, a first outer ferrule grounding wing 58, and a second outer ferrule grounding wing 60. First outer ferrule grounding wing 58 and second outer ferrule grounding wing 60 extend from opposing sides of outer ferrule grounding section base portion 56 such that outer ferrule grounding section 44 may be substantially V-shaped or U-shaped as shown in FIGS. 1 and 3 prior to assembly of outer ferrule 26 to shielded cable 10. Outer ferrule grounding section base portion 56 may be arcuate in shape as shown. First outer ferrule grounding wing 58 is attached at one end to outer ferrule grounding section base portion 56 while the other end is free and defines a first outer ferrule grounding wing free end 62. Similarly, second outer ferrule grounding wing 60 is attached at one end to outer ferrule grounding section base portion 56 while the other end is free and defines a second outer ferrule grounding wing free end 64. Outer ferrule grounding section 44 is linked to outer ferrule to cable attachment section 42 by an outer ferrule linking strap 66. Outer ferrule grounding section 44 is provided for connection to ground or a conductor connected to ground, thereby grounding conductive shield layer 20. While outer ferrule grounding section 44 has been illustrated and described, outer ferrule grounding section 44 may be omitted. If outer ferrule grounding section 44 is omitted, outer ferrule to cable attachment section 42 is connected directly to ground or directly to a conductor connected to ground, thereby grounding conductive shield layer 20.

Outer ferrule 26 may be formed from a sheet of electrically conductive sheet stock by conventional metal forming techniques such as punching and stamping. As shown in FIG. 3, outer ferrule 26 may be formed with an outer ferrule carrier strip 68 and connected thereto with an outer ferrule carrier connecting strap 70. While not shown, outer ferrule carrier strip 68 may include a plurality of outer ferrules 26 in order to facilitate automated production of outer ferrules 26 and also to facilitate automated assembly of outer ferrule 26 to shielded cable 10. Assembly of outer ferrule 26 to shielded cable 10 will be discussed in detail later.

Figure 5:
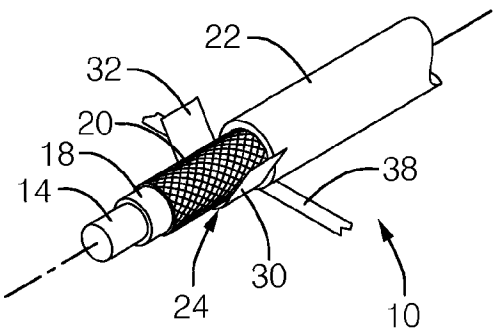
FIG. 5 is an isometric view of the shielded cable of FIG. 4 with the inner ferrule of FIG. 2 positioned adjacent to a conductive shield layer of the shielded cable.

A first embodiment of assembling grounding arrangement 12 to shielded cable 10 will now be discussed with continued reference to FIG. 1 and with additional reference to FIGS. 4-9. As shown in FIG. 4, shielded cable 10 has been prepared as previously described in order to receive grounding arrangement 12. After shielded cable 10 has been prepared to receive grounding arrangement 12, inner ferrule 24 is positioned adjacent to the end portion of conductive shield layer 20 that has been exposed by removing a length of outer insulation layer 22 as shown in FIG. 5. Inner ferrule 24 is also positioned to axially abut or to be axially proximal to outer insulation layer 22. When inner ferrule 24 is positioned adjacent to conductive shield layer 20, conductive shield layer 20 extends axially beyond inner ferrule 24 toward the portion of conductive core 14 that has been exposed.

Figure 6:
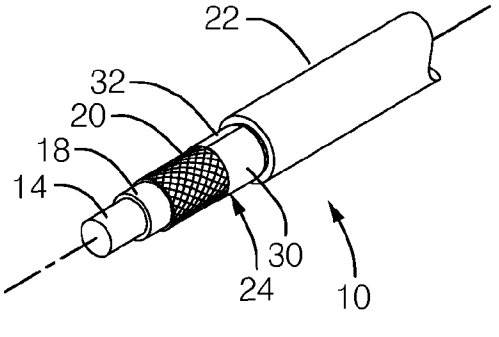
FIG. 6 is an isometric view of the shielded cable of FIG. 5 with the inner ferrule crimped around the conductive shield layer.

First inner ferrule crimp wing 30 and second inner ferrule crimp wing 32 are then crimped or deformed around conductive shield layer 20 as shown in FIG. 6, thereby fixing inner ferrule 24 to shielded cable 10. It should be noted that since conductive shield layer 20 radially surrounds core insulation layer 18, the step of crimping or deforming first inner ferrule crimp wing 30 and second inner ferrule crimp wing 32 around conductive shield layer 20 also crimps or deforms first inner ferrule crimp wing 30 and second inner ferrule crimp wing 32 around core insulation layer 18. Inner ferrule carrier strip 38 may be removed from inner ferrule 24 in the same step that crimps or deforms first inner ferrule crimp wing 30 and second inner ferrule crimp wing 32 around conductive shield layer 20.

Figure 7:
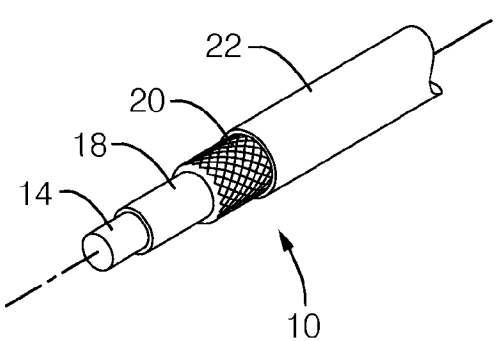
FIG. 7 is an isometric view of the shielded cable of FIG. 6 with the conductive shield layer positioned over the inner ferrule.

After inner ferrule 24 has been fixed to shielded cable 10, conductive shield layer 20 is positioned to radially surround inner ferrule 24 as shown in FIG. 7. Conductive shield layer 20 is positioned to radially surround inner ferrule 24 by folding conductive shield layer 20 backward over inner ferrule 24. It should be noted that inner ferrule 24 is obscured by conductive shield layer 20 in FIGS. 7-9 because conductive shield layer 20 now radially surrounds inner ferrule 24.

Figure 8:
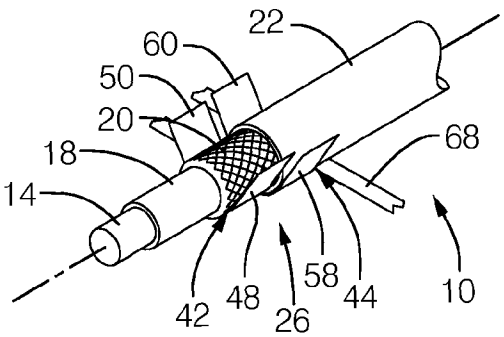
FIG. 8 is an isometric view of the shielded cable of FIG. 7 with the outer ferrule of FIG. 3 positioned adjacent to the conductive shield layer.

After conductive shield layer 20 is positioned radially outward of inner ferrule 24, outer ferrule 26 is positioned relative to shielded cable 10 such that outer ferrule to cable attachment section 42 is radially adjacent to the portion of conductive shield layer 20 that is positioned radially outward of inner ferrule 24 and such that outer ferrule grounding section 44 is radially outward of outer insulation layer 22 as shown in FIG. 8. As shown, outer ferrule to cable attachment section 42 may axially abut or may be axially proximal to outer insulation layer 22.

Figure 9:
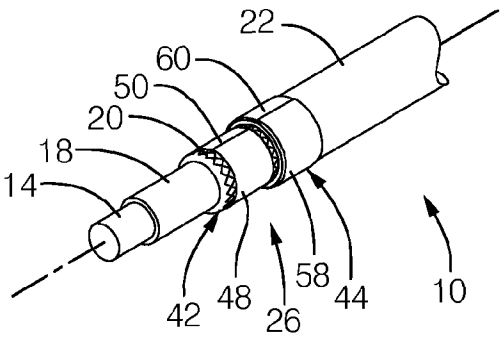
FIG. 9 is an isometric view of the shielded cable of FIG. 8 with the outer ferrule crimped around the conductive shield layer.

After outer ferrule 26 has been positioned relative to shielded cable 10 as shown in FIG. 8, first outer ferrule crimp wing 48 and second outer ferrule crimp wing 50 are crimped or deformed around conductive shield layer 20 as shown in FIG. 9, thereby fixing outer ferrule 26 to shielded cable 10. In this way, conductive shield layer 20 is captured and clamped securely radially between inner ferrule 24 and outer ferrule to cable attachment section 42 of outer ferrule 26, thereby ensuring a good electrically conductive interface between conductive shield layer 20 and outer ferrule 26. It should be noted that the majority of conductive shield layer 20 is obscured in FIG. 9 because outer ferrule to cable attachment section 42 now radially surrounds conductive shield layer 20.

First outer ferrule grounding wing 58 and second outer ferrule grounding wing 60 may be crimped or deformed around outer insulation layer 22 as shown in FIG. 9 at the same time that first outer ferrule crimp wing 48 and second outer ferrule crimp wing 50 are crimped or deformed around conductive shield layer 20. First outer ferrule grounding wing 58 and second outer ferrule grounding wing 60 may be crimped or deformed around outer insulation layer 22 to either grip outer insulation layer 22 tightly or alternatively an annular space may be formed between outer ferrule grounding section 44 and outer insulation layer 22. Outer ferrule carrier strip 68 may be removed from outer ferrule 26 in the same step that crimps or deforms first inner ferrule crimp wing 30 and second inner ferrule crimp wing 32 around conductive shield layer 20 and first outer ferrule grounding wing 58 and second outer ferrule grounding wing 60 around outer insulation layer 22. It should be noted that first outer ferrule grounding wing 58 and second outer ferrule grounding wing 60 may alternatively be crimped or deformed around outer insulation layer 22 either before or after first inner ferrule crimp wing 30 and second inner ferrule crimp wing 32 are crimped or deformed around conductive shield layer 20.

A second embodiment of assembling grounding arrangement 12 to shielded cable 10 will now be discussed with reference to FIGS. 10-16. As shown in FIG. 10, shielded cable 10 has been prepared as previously described in order to receive grounding arrangement 12. Next, as shown in FIG. 11, the end portion of conductive shield layer 20 that has been exposed is folded backward over outer insulation layer 22. After conductive shield layer 20 has been folded backward over outer insulation layer 22, inner ferrule 24 is positioned adjacent to the portion of core insulation layer 18 that has been exposed by folding conductive shield layer 20 backward over outer insulation layer 22 as shown in FIG. 12. Inner ferrule 24 is also positioned axially adjacent to conductive shield layer 20 by axially abutting or being axially proximal to conductive shield layer 20. When inner ferrule 24 is positioned adjacent to core insulation layer 18 and conductive shield layer 20, core insulation layer 18 extends axially beyond inner ferrule 24 toward the portion of conductive core 14 that has been exposed.

First inner ferrule crimp wing 30 and second inner ferrule crimp wing 32 are then crimped or deformed around core insulation layer 18 as shown in FIG. 13, thereby fixing inner ferrule 24 to shielded cable 10. Inner ferrule carrier strip 38 may be removed from inner ferrule 24 in the same step that crimps or deforms first inner ferrule crimp wing 30 and second inner ferrule crimp wing 32 around core insulation layer 18.

After inner ferrule 24 has been fixed to shielded cable 10, conductive shield layer 20 is positioned to radially surround inner ferrule 24 as shown in FIG. 14. Conductive shield layer 20 is positioned to radially surround inner ferrule 24 by folding conductive shield layer 20 forward over inner ferrule 24 as shown in FIG. 14. It should be noted that inner ferrule 24 is obscured by conductive shield layer 20 in FIGS. 14-16 because conductive shield layer 20 radially surrounds inner ferrule 24.

After conductive shield layer 20 is positioned to radially surround inner ferrule 24, outer ferrule 26 is positioned relative to shielded cable 10 such that outer ferrule to cable attachment section 42 is radially adjacent to the portion of conductive shield layer 20 that is positioned radially outward of inner ferrule 24 and such that outer ferrule grounding section 44 is radially outward of outer insulation layer 22 as shown in FIG. 15. As shown, outer ferrule to cable attachment section 42 may axially abut or may be axially proximal to outer insulation layer 22.

After outer ferrule 26 has been positioned relative to shielded cable 10 as shown in FIG. 15, first outer ferrule crimp wing 48 and second outer ferrule crimp wing 50 are crimped or deformed around conductive shield layer 20 as shown in FIG. 16, thereby fixing outer ferrule 26 to shielded cable 10. In this way, conductive shield layer 20 is captured and clamped securely radially between inner ferrule 24 and outer ferrule to cable attachment section 42 of outer ferrule 26, thereby ensuring a good electrically conductive interface between conductive shield layer 20 and outer ferrule 26. It should be noted that the majority of conductive shield layer 20 is obscured in FIG. 16 because outer ferrule to cable attachment section 42 now radially surrounds conductive shield layer 20.

First outer ferrule grounding wing 58 and second outer ferrule grounding wing 60 may crimped or deformed around outer insulation layer 22 as shown in FIG. 16 at the same time that first outer ferrule crimp wing 48 and second outer ferrule crimp wing 50 are crimped or deformed around conductive shield layer 20. First outer ferrule grounding wing 58 and second outer ferrule grounding wing 60 may be crimped or deformed around outer insulation layer 22 to either grip outer insulation layer 22 tightly or alternatively an annular space may be formed between outer ferrule grounding section 44 and outer insulation layer 22. Outer ferrule carrier strip 68 may be removed from outer ferrule 26 in the same step that crimps or deforms first inner ferrule crimp wing 30 and second inner ferrule crimp wing 32 around conductive shield layer 20 and first outer ferrule grounding wing 58 and second outer ferrule grounding wing 60 around outer insulation layer 22. It should be noted that first outer ferrule grounding wing 58 and second outer ferrule grounding wing 60 may alternatively be crimped or deformed around outer insulation layer 22 either before or after first inner ferrule crimp wing 30 and second inner ferrule crimp wing 32 are crimped or deformed around conductive shield layer 20.

Figure 17:
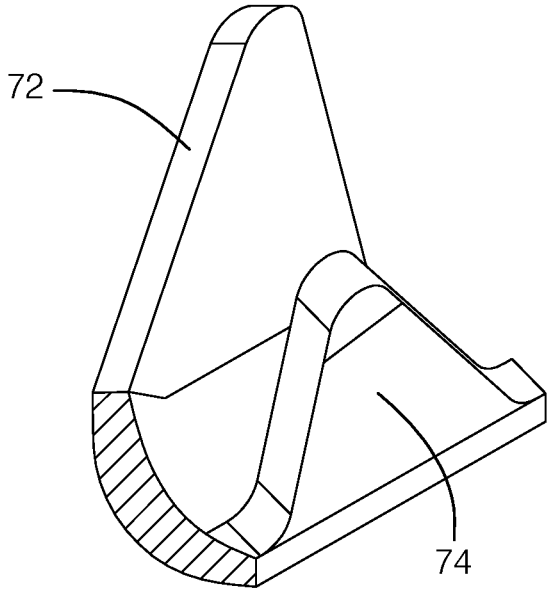
FIG. 17 is an isometric view of a bypass wing arrangement.
Figure 18:
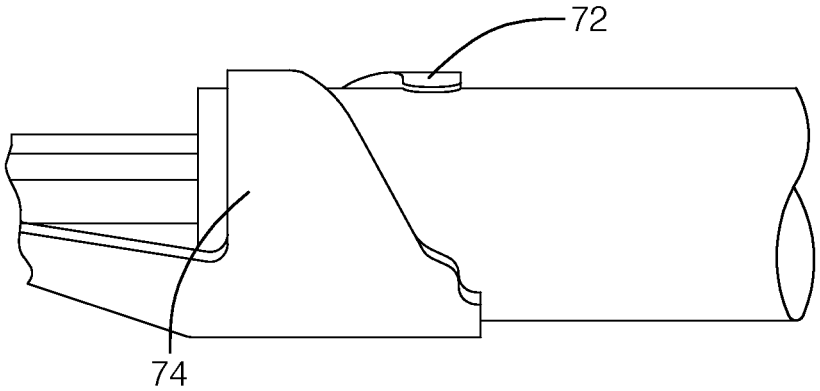
FIG. 18 is the bypass wing arrangement of FIG. 17 shown crimped onto a cable.

First inner ferrule crimp wing 30 and second inner ferrule crimp wing 32 have been illustrated as rectangular in shape such that when first inner ferrule crimp wing 30 and second inner ferrule crimp wing 32 have been crimped or deformed, first inner ferrule crimp wing free end 34 and second inner ferrule crimp wing free end 36 are adjacent to each other. Similarly, first outer ferrule crimp wing 48 and second outer ferrule crimp wing 50 have been illustrated as rectangular in shape such that when first outer ferrule crimp wing 48 and second outer ferrule crimp wing 50 have been crimped or deformed, first outer ferrule crimp wing free end 52 and second outer ferrule crimp wing free end 54 are adjacent to each other. Also similarly, first outer ferrule grounding wing 58 and second outer ferrule grounding wing 60 have been illustrated as rectangular in shape such that when first outer ferrule grounding wing 58 and second outer ferrule grounding wing 60 are deformed around outer insulation layer 22, first outer ferrule grounding wing free end 62 and second outer ferrule grounding wing free end 64 are adjacent to each other. It should now be understood that the crimp wings and ground wings may be formed in other shapes. Similarly, it should now be understood that different numbers of crimp wings and ground wings may be included. FIGS. 17 and 18 illustrate a bypass wing arrangement with a first bypass wing 72 and a second bypass wing 74 which are each formed as triangles. As can be seen, the triangular nature of first bypass wing 72 and second bypass wing 74 allow the bypass wings to bypass each other, thereby preventing first bypass wing 72 from contacting second bypass wing 74. The triangular nature of first bypass wing 72 and second bypass wing 74 thereby allows different gauge wires to be used with the same ferrule while still allowing first bypass wing 72 and second bypass wing 74 to sufficiently radially surround the cable. First bypass wing 72 and second bypass wing 74 may be used in the place of any or all of first inner ferrule crimp wing 30, second inner ferrule crimp wing 32, first outer ferrule crimp wing 48, second outer ferrule crimp wing 50, first outer ferrule grounding wing 58 and second outer ferrule grounding wing 60.

Grounding arrangement 12 allows for reduced costs by producing inner ferrule 24 and outer ferrule 26 by punching and stamping of sheet stock rather than by forming individual loose pieces. Plating of inner ferrule 24 and outer ferrule 26 can therefore be performed on the sheet stock rather than on individual loose pieces. Furthermore, since the wings of the ferrules are made by stamping, they can be designed to accommodate multiple sizes of cable. The methods disclosed herein for attaching grounding arrangement 12 to shielded cable 10 allows inner ferrule 24 and outer ferrule 26 to be more easily and more quickly attached to shielded cable 10, thereby reducing production time and costs.

While not shown, it should be understood that a cable terminal may be placed in electrical communication with conductive core 14 in conventional fashion in order to interface with a mating terminal of, for example only, an electrical device or an electrical connector.

While this invention has been described in terms of preferred embodiments thereof, it is not intended to be so limited, but rather only to the extent set forth in the claims that follow.

We claim:

1. A method for forming a grounding arrangement on a shielded cable that includes a conductive core, a core insulation layer radially surrounding said conductive core, a conductive shield layer radially surrounding said core insulation layer, and an outer insulation layer radially surrounding said conductive shield layer, said method comprising:

removing a length of said outer insulation layer to expose an end portion of said conductive shield layer;

providing an inner ferrule configured to be crimped around said core insulation layer;

positioning said inner ferrule adjacent to said end portion of said conductive shield layer that has been exposed;

crimping said inner ferrule around said core insulation layer;

folding said end portion of said conductive shield layer that has been exposed over said inner ferrule to radially surround said inner ferrule;

providing an electrically conductive outer ferrule configured to be crimped around said inner ferrule;

positioning said outer ferrule radially adjacent to said end portion of said conductive shield layer that has been positioned to radially surround said inner ferrule; and crimping said outer ferrule radially around said inner ferrule to capture said end portion of said conductive shield layer radially between said inner ferrule and said outer ferrule, thereby fixing said outer ferrule in electrical contact with said conductive shield layer.

2. The method in accordance with claim 1 wherein said step of providing said inner ferrule includes providing said inner ferrule attached to an inner ferrule carrier strip.

3. The method in accordance with claim 2 further comprising removing said inner ferrule carrier strip from said inner ferrule after said step of positioning said inner ferrule.

4. The method in accordance with claim 1 wherein said step of providing said outer ferrule includes providing said outer ferrule attached to an outer ferrule carrier strip.

5. The method in accordance with claim 4 further comprising removing said outer ferrule carrier strip from said outer ferrule.

6. The method in accordance with claim 1 wherein said step of crimping said inner ferrule around said core insulation layer includes crimping said inner ferrule around said conductive shield layer.

7. The method in accordance with claim 6 wherein said step of folding said end portion includes folding said end portion backward over said inner ferrule.

8. The method in accordance with claim 1 further comprising folding said end portion of said conductive shield layer backward over said outer insulation layer prior to said step of folding said end portion over said inner ferrule.

9. The method in accordance with claim 8 wherein said step of folding said end portion over said inner ferrule includes folding said end portion of said conductive shield layer forward over said inner ferrule after said step of crimping said inner ferrule around said core insulation layer.

10. The method in accordance with claim 1 wherein said outer ferrule includes an outer ferrule to cable attachment section configured to be crimped around said inner ferrule and wherein said outer ferrule also includes an outer ferrule grounding section axially spaced from said outer ferrule to said cable attachment section.

11. The method in accordance with claim 10 wherein said outer ferrule to cable attachment section is linked to said outer ferrule grounding section by an outer ferrule linking strap.

12. The method in accordance with claim 10 further comprising positioning said outer ferrule grounding section radially adjacent to said outer insulation layer.

13. The method in accordance with claim 12 wherein said step of positioning said outer ferrule grounding section radially adjacent to said outer insulation layer is performed concurrently with said step of positioning said outer ferrule radially adjacent to said end portion of said conductive shield layer that has been positioned to radially surround said inner ferrule.

14. The method in accordance with claim 13 wherein said outer ferrule grounding section includes outer ferrule grounding wings.

15. The method in accordance with claim 14 further comprising deforming said outer ferrule grounding wings around said outer insulation layer.

16. The method in accordance with claim 15 wherein said step of deforming said outer ferrule grounding wings around said outer insulation layer is performed after said step of positioning said outer ferrule adjacent to said end portion of said conductive shield layer that has been positioned to radially surround said inner ferrule.

17. The method in accordance with claim 1 wherein said inner ferrule includes inner ferrule crimp wings and said step of crimping said inner ferrule around said core insulation layer includes deforming said inner ferrule crimp wings around said core insulation layer after said step of positioning said inner ferrule adjacent to said end portion of said conductive shield layer that has been exposed.

18. The method in accordance with claim 1 wherein said outer ferrule includes outer ferrule crimp wings and said step of crimping said outer ferrule radially around said inner ferrule includes deforming said outer ferrule crimp wings radially around said inner ferrule to capture said end portion of said conductive shield layer radially between said inner ferrule and said outer ferrule, thereby fixing said outer ferrule in electrical contact with said conductive shield layer.

* * * * *